United States Patent [19]

Osborne, Jr.

[11] 4,406,187

[45] Sep. 27, 1983

[54] ANCHORING MECHANISM FOR MOTOR DRIVEN WRENCH

[75] Inventor: Thomas D. Osborne, Jr., Chino, Calif.

[73] Assignee: Frank A. Klaus, Brea, Calif.

[21] Appl. No.: 224,002

[22] Filed: Jan. 12, 1981

[51] Int. Cl.[3] ..... B25B 13/48

[52] U.S. Cl. ..... 81/180 R

[58] Field of Search ..... 81/180 R; 408/97, 98, 408/115 R

[56] References Cited

U.S. PATENT DOCUMENTS 2,459,672 1/1949 Morsch ..... 81/180 R X
3,069,933 12/1962 McCall ..... 408/115 R X
4,005,622 2/1977 Bassett ..... 81/180 R
4,015,490 4/1977 Burrous ..... 81/180 R

*Primary Examiner*—James G. Smith
*Attorney, Agent, or Firm*—Hubbard & Stetina

[57] ABSTRACT

An anchoring mechanism for preventing the counter-rotation of a motor driven wrench in reaction to the torque produced by the turning of a tool member therein has a multiplicity of members tandemly hinged together, one end member having elements for attaching to a motor driven wrench and the other end member having elements for securing to a fixed reference base whereby the motor driven wrench is prevented from rotating in reaction to the turning of a tool member therein.

3 Claims, 6 Drawing Figures

ANCHORING MECHANISM FOR MOTOR DRIVEN WRENCH

The present invention relates to adjustable jigs for positioning power tools and more particularly to an anchoring attachment for motor driven wrenches.

In the field of building construction using steel beams and girders, it has been the general practice to use a variety of devices ranging from hand reamers to heavy duty motor driven drill units with reamer bits to ream the pre-punched holes in the beams and girders in order to obtain the required hole alignment to permit a bolt to be inserted therethrough. These alignment problems are encountered during erection of the steel beam and girder framing. The misaligned holes, therefore, must be reamed on the job at the point in the steelwork framing where they are encountered. Although the various techniques of reaming from hand reaming to heavy duty drill reaming have served the purpose, they have not proved satisfactory under all conditions of application for the reason that hand reamers required great physical effort from the operator coupled with excessive amounts of time and the heavy duty drill units required anchoring either by magnets or by one or more persons in addition to the operator to hold the drill unit with long torque-bar extensions to resist the torque developed by the heavy duty drill unit. The present invention overcomes these problems.

A recent development in high strength bolt fastening is the torque-shear bolt which can be installed by light weight motor driven wrenches. These light weight motor driven wrenches employ a high gear reduction ratio to provide a high torque drive to an inner socket and a co-axial outer socket in counter-rotation. The inner socket engages the fluted end of the torque-shear bolt and the outer socket engages a nut threadably engaged on the bolt adjacent the fluted end. The nut is turned by the outer socket until the nut is driven to the desired tightness as determined by the shearing torque of the fluted end of the torque-shear bolt. This enables the operator to install a bolt requiring a high installation torque without transmitting the reaction torque to the operator. These light weight counter-rotating coaxial motor driven wrenches are becoming quite popular in the construction industry throughout the world.

In view of the growing use of the coaxial counter-rotating wrench in the industry, it is needed to have this light weight unit adaptable to performing the required reaming operations on the construction sites. The present invention fulfills this need.

Since the position of the operator of a motor driven wrench in many reaming applications is often precarious, atop or astride a beam at dangerous heights, the sudden engagement or grabbing of the reamer tool in the hole being reamed and the reaction torque produced could propel the wrench operator from the beam resulting in death or serious injury. The present invention overcomes this difficulty.

One of the most critical problems confronting designers of motor driven wrenches has been how to prevent the wrench operators from having to physically resist the counter-rotation of the wrench when a reamer is being turned therein. This problem is overcome by the present invention.

The general purpose of this invention is to provide an anchoring attachment for motor driven wrenches so that the wrench embraces all of the advantages of motor driven wrenches heretofore and possesses none of the afore-described disadvantages. To attain this, the present invention contemplates a unique hinged tandem assembly of extension and elevating members, one end of which is attached to the motor driven wrench and the other end is attached to a fixed reference base whereby rotation of the wrench in reaction to the turning of a tool therein is avoided.

An object of the present invention is the provision of an anchoring attachment for motor driven wrenches which prevents the rotation of the wrench in reaction to the turning of a tool therein.

Another object is to provide a positioning and stabilizing assembly for attachment to the outer socket of a torque-shear wrench to prevent the counter-rotation of the wrench in reaction to the torque produced by the turning of a tool member engaged in the coaxial inner socket of the wrench.

Other objects and many of the attendant advantages of this invention will be readily appreciated as the same becomes better understood by reference to the following detailed description when considered in connection with the accompanying drawings in which like reference numerals designate like parts throughout the figures thereof and wherein.

Figure 1:
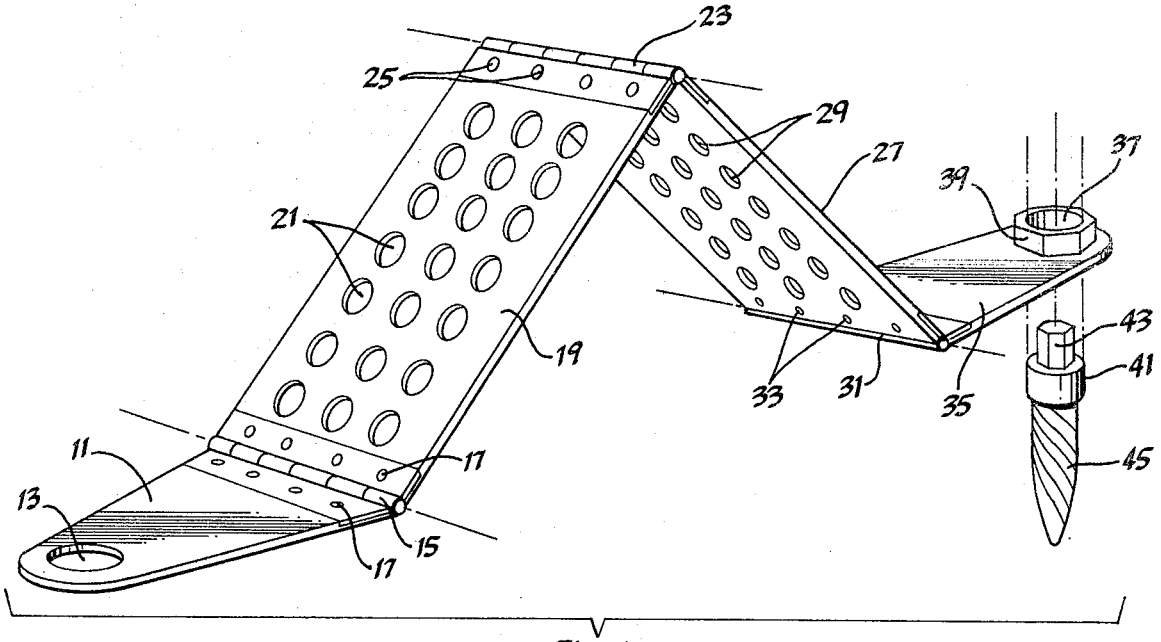
FIG. 1 shows an exploded perspective view of a preferred embodiment of the invention.

Referring now to the drawings, wherein like reference characters designate like or corresponding parts throughout the several views, there is shown in FIG. 1 (which illustrates a preferred embodiment) a base member 11 having means for fastening to a base of fixed reference comprising an opening 13 constructed and adapted to receive a bolt therethrough for fastening to a base of fixed reference. Base member 11 is hingedly attached by means of a first hinge 15 to an extension member 19. First hinge fasteners 17 attach hinge 15 to base member 11 and extension member 19. Extension member 19 has a multiplicity of holes 21 therein to reduce or lighten the weight of the extension member yet retaining the structural strength thereof. Extension member 19 in turn is hingedly connected by a second hinge 23 to an elevating member 27. Second hinge fasteners 25 attach hinge 23 to extension member 19 and to elevating member 27 (fasteners not visible on member 27). Elevating member 27 has a multiplicity of holes 29 therein to reduce or lighten the weight of elevating member 27 yet retaining the structural strength thereof similar to extension member 19. Elevating member 27 in turn is hingedly attached by a third hinge 31 to a wrench connecting member 35. Third hinge fasteners 33 connect hinge 31 to elevating member 27 and wrench connecting member 35 (fasteners not visible on member 35). Wrench connecting member 35 has a receptacle 37 therethrough surrounded by a collar 39 having its outer surface in the shape of a multi-faceted polygon such as the multi-faceted surfaces of a nut. The multi-faceted surfaces around collar 39 are constructed and adapted to be engaged by the outer socket of a counter-rotating coaxial wrench. A reamer tool has a cylindrical shoulder 41 which slides into receptacle 37 and allows the reamer to rotate freely therein. The reamer tool has a fluted end 43 comprising a multiplicity of faceted surfaces which are constructed and adapted to be received in the inner socket of a counter-rotating coaxial wrench. The reamer tool has a reaming end 45 comprising a series of grooves and ridges constructed and adapted to ream out a hole into which reamer end 45 is inserted.

Figure 2:
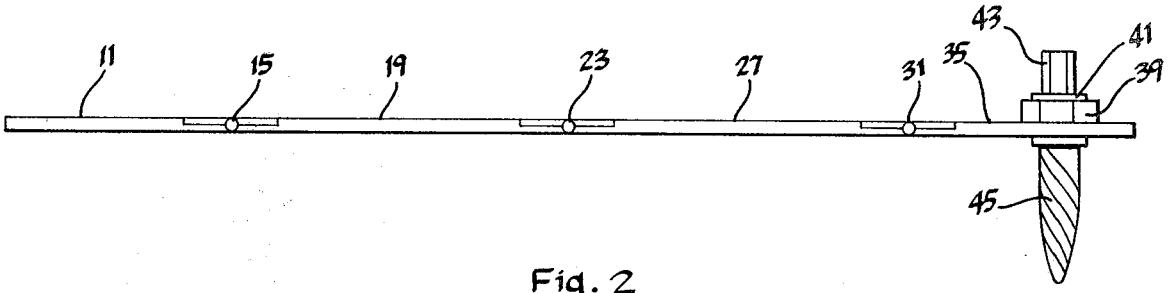
FIG. 2 shows a side elevation of the apparatus shown in FIG. 1.

FIG. 2 shows a side view of the apparatus of FIG. 1 in full extension. Base member 11 is shown tandemly connected by hinge 15 to extension member 19 which in turn is tandemly connected by hinge 23 to elevating member 27 to which wrench connecting member 35 is tandemly connected by hinge 31. The reamer tool is illustrated in rotatable engagement within collar 39.

Figure 3:
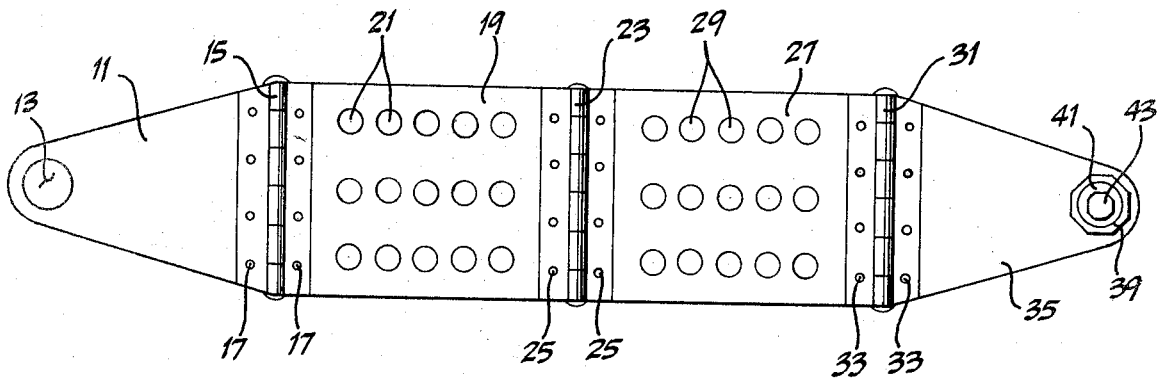
FIG. 3 illustrates a top view of the apparatus shown in FIG. 1.

FIG. 3 illustrates a top view of the fully extended anchoring mechanism illustrated in FIG. 2 showing the fastener elements 17 of hinge 15 engaging base member 11 and extension member 19 and similarly fastener elements 25 of hinge 23 engaging extension member 19 and elevating member 27 and finally fastener members 33 connecting hinge 31 to elevating member 27 and wrench connecting member 35.

Figure 4:
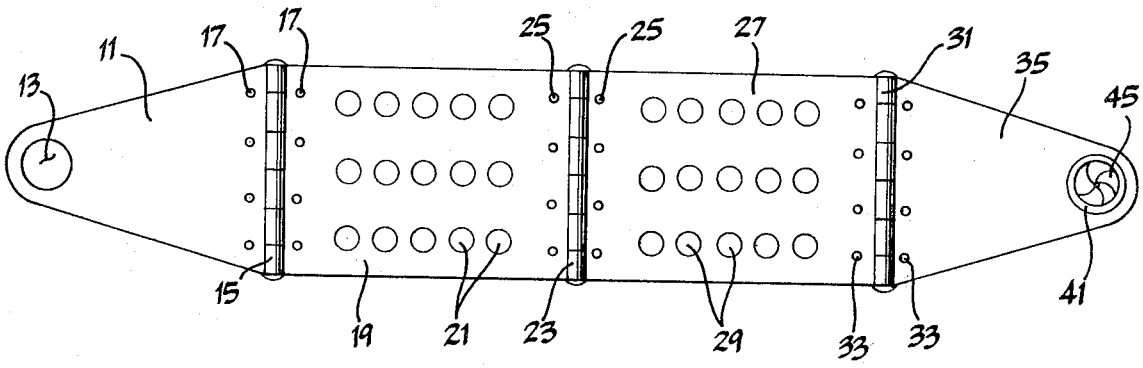
FIG. 4 illustrates a bottom view of the apparatus illustrated in FIG. 1.

FIG. 4 illustrates the bottom view of the fully extended tandem apparatus of FIGS. 1 and 2.

Figure 5:
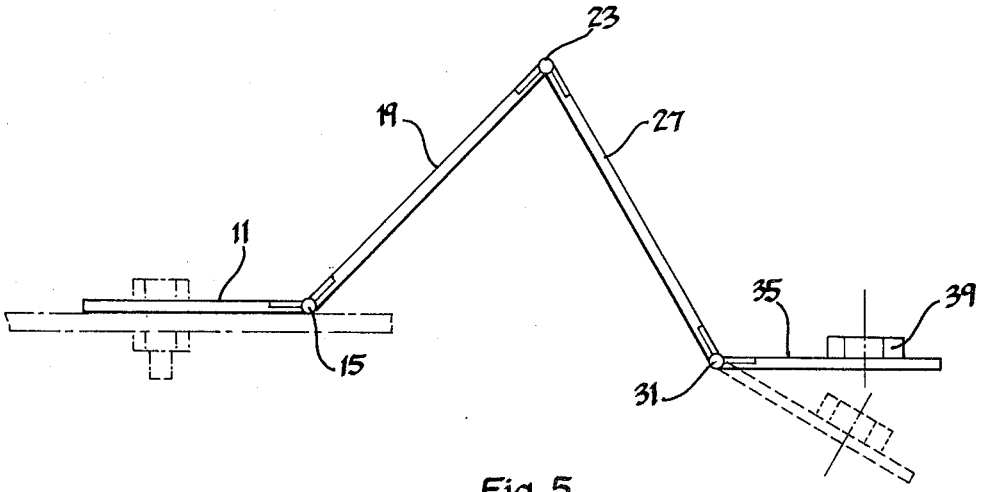
FIG. 5 shows a side view of the apparatus shown in FIG. 1 in an operating configuration.

FIG. 5 shows a side view of the anchoring mechanism of FIG. 1 having base member 11 in fixed relation to a beam member shown in dashed lines and fastened thereto by a bolt and nut also shown in dashed lines. Wrench connecting member 35 is shown in a horizontal position at an elevation below base member 11 but substantially parallel thereto. A second position of base member 35 is shown in dashed lines indicating the adjustable position of wrench connecting member 35 about the axis of hinge 31.

Figure 6:
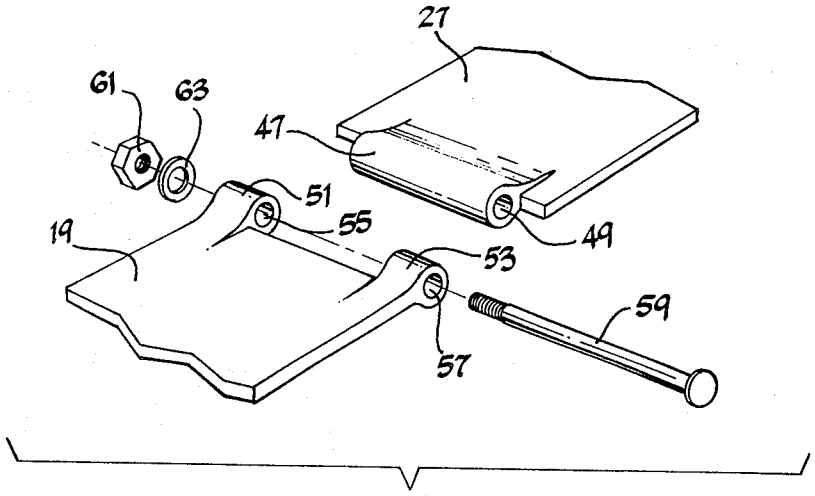
FIG. 6 shows an exploded perspective view of a rugged hinge assembly for use with the apparatus shown in FIG. 1.

FIG. 6 illustrates a heavy duty or more rugged hinge construction which can be utilized in place of the hinges illustrated in FIGS. 1–5. A heavy duty hinge leaf 47 is centrally located at the end of elevating member 27 and is interleaved between a pair of heave duty hinge elements 51 and 53 connected to extension member 19. Heavy duty hinge members 47, 51 and 53 have holes 49, 55 and 57 therethrough, respectively, to receive a bolt 59 therethrough for coupling together the rugged, heavy duty hinge leafs. Bolt 59 is held in place by a nut 61 threadably engaged thereon along with a washer 63 in rotational engagement therewith.

In all of the figures the rotational axis of each of the hinges 15, 23 and 31 are parallel to each other. This enables wrench connecting member 35 to be rotated into a plane parallel with base member 11. It is contemplated that other mechanical configurations may be utilized where the axes are not parallel.

Operation of the anchoring device can be best understood by referring first to FIG. 5. Base member 11 is rotatably attached by a bolt to a point of fixed reference (shown by the dashed lines). Extension member 19 is rotated about hinge 15, elevating member 27 is rotated about hinge 23 and wrench connecting member 35 is rotated about hinge 31 in order to place collar 39 above a hole to be reamed in a girder or beam. The entire anchoring mechanism may be rotated about the bolt through base member 11 in order to angularly position wrench connecting member 35 at the desired location. In this manner, wrench connecting member 35 may be positioned at any distance and any elevation relative to base member 11 within the constraints of the dimensions of extension member 19 and elevating member 27. The outer socket of a counter-rotating coaxial wrench engages collar 39 and is prevented from rotating by the anchoring mechanism which is attached to a fixed point of reference by a bolt through base member 11.

Now, referring to FIG. 1, the inner socket of a counter-rotating coaxial wrench is connected to the fluted end 43 of the reamer. When the wrench is operated, the inner socket rotates with respect to the outer socket held stationary by the anchoring mechanism to which it is attached. Therefore, as the reamer rotates and reams a hole into which it is inserted, the outer socket and the counter-rotating wrench is held securely against the counter torque produced as the reaming tool engages the surface of the hole which is being reamed. This eliminates the necessity of the operator of the counter-rotating coaxial wrench from physically having to resist the counter torque and to hold the wrench against the twisting and turning forces produced by the engagement of the reamer tool.

It is contemplated that the construction worker can carry the anchoring mechanism for reaming holes attached to or hung from his belt. When hole alignment problems are encountered, he removes the mechanism from his belt, attaches one end by a bolt to a nearby hole in a beam, or clamps the one end to the beam and attaches the other end to the motor driven wrench. By means of the hinged flexible joints, the motor driven wrench with a reamer tool rotatably engaged therein can be moved horizontally and vertically enabling the operator safely to ream holes in any location through different thicknesses of steel. Upon completion of the reaming operation, the operator removes the anchoring mechanism from the beam or girder and the wrench, fastens the mechanism to his belt and resumes the bolt fastening of the girders and beams together resulting in the saving of time and safe performance in his job.

It now should be apparent that the present invention provides a mechanical arrangement of hinged members which may be employed in conjunction with a coaxial counter-rotating motor driven wrench for preventing the counter-rotation of the wrench in reaction to the torque produced by the turning of a tool member therein.

Although particular components, etc., have been discussed in connection with a specific embodiment of an anchoring device constructed in accordance with the teachings of the present invention, others may be utilized. Furthermore, it will be understood that although an exemplary embodiment of the present invention has been disclosed and discussed, other applications and mechanical arrangements are possible and that the embodiments disclosed may be subjected to various changes, modifications and substitutions without necessarily departing from the spirit of invention.

What is claimed is:

1. An anchoring attachment for a counter-rotating coaxial wrench having an inner socket and an outer socket, comprising:

a base member having means for fastening to a base of fixed reference;

an extension member hingedly attached to said base member about a first hinge axis whereby said extension member may be rotated with respect to said base member about the hinge axis;

an elevating member hingedly attached to said extension member about a second hinge axis parallel to said first hinge axis whereby said elevating member may be rotated with respect to said extension member about said second hinge axis; and a wrench connecting member hingedly attached to said elevating member about a third hinge axis parallel to said first hinge axis and said second hinge axis, said wrench connecting member having a receptacle therein to receive in rotary engagement therewith a tool, said receptacle having a collar therearound fixedly attached to said wrench connecting member and constructed and adapted to engage the outer socket of a coaxial counter-rotating wrench with the inner socket of the wrench engaging a tool to be rotated in said receptacle of said wrench connecting member whereby by fastening said base member to a base of fixed reference, the outer socket of the counter-rotating wrench is prevented from rotating in response to the reaction torque produced by the rotation of the tool in the inner socket and said extension member, said elevating member and said tool member allow a coaxial counter-rotating wrench and the rotating tool therein to be positioned both horizontally and vertically in a desired location.

2. The anchoring attachment described in claim 1 wherein said means for fastening to a base of fixed reference includes an opening in said base member to receive a bolt therethrough.

3. The anchoring attachment described in claim 2 further including a multiplicity of openings in said extension member and said elevating member to reduce the weight of the members while preserving their structural strength.

* * * * *